US005558172A

United States Patent [19]

Millsapps, Jr.

[11] Patent Number: 5,558,172

[45] Date of Patent: Sep. 24, 1996

[54] EARTH BORING BIT AND LUBRICATOR COMPENSATION THEREFOR

[75] Inventor: Stuart C. Millsapps, Jr., Austin, Tex.

[73] Assignee: Briscoe Tool Company, Houston, Tex.

[21] Appl. No.: 347,705

[22] Filed: Dec. 1, 1994

[51] Int. Cl.[6] ..... E21B 10/22

[52] U.S. Cl. ..... 175/228; 384/93

[58] Field of Search ..... 175/228, 227, 175/371; 384/93

[56] References Cited

U.S. PATENT DOCUMENTS

| | | | |
|---|---|---|---|
| 3,942,596 | 3/1976 | Millsapps, Jr. | 175/227 |
| 4,055,225 | 10/1977 | Millsapps, Jr. | 175/228 |
| 4,407,375 | 10/1983 | Nakamura | 175/228 |
| 4,593,775 | 6/1986 | Chaney et al. | 175/228 |
| 4,598,778 | 7/1986 | Highsmith | 175/371 |
| 4,727,942 | 3/1988 | Galle et al. | 175/228 |
| 4,865,136 | 9/1989 | White | 175/227 |
| 4,942,930 | 7/1990 | Millsapps, Jr. | 175/228 |

OTHER PUBLICATIONS

Hughes Tool Company, 1988–89 Oilfield Catalog, pp. 4 and 5.

Reed Tool Company, Product Catalog, p. 6.

Rock Bit International, General Catalog, p. 11.

Security, 1980/81 General Catalog, p. 5.

Walker–McDonald, Product Catalog, Oil & Gas Drilling, pp. 7 and 8.

*Primary Examiner*—Hoang C. Dang

*Attorney, Agent, or Firm*—Browning Bushman

[57] ABSTRACT

A well drilling bit comprises a bit body with a centralized portion and a plurality of radially and circumferentially spaced legs depending longitudinally therefrom. A respective cutter body is rotatably mounted on the free end of each leg with bearing means. The bit body has a respective lubricant passage communicating with each bearing and a respective upwardly opening lubricant reservoir recess, the recess also communicating with a respective vent port opening downwardly through the bit body. A respective lubricating mechanism is disclosed in each lubricant reservoir recess, and each such mechanism comprises an elastomeric pressure compensating diaphragm extending across the recess and sealed with respect thereto, dividing the recess into a lower portion communicating with the vent port and an upper portion communicating with the lubricant passage. The mechanism also comprises an integral diaphragm protector located generally above the diaphragm in the upper portion of the lubricant reservoir recess, having a primary, downwardly opening cavity for receipt of lubricant and aligned to receive the diaphragm when the diaphragm is contracted. The protector has a flow path communicating the interior of the primary cavity with the upper portion of the reservoir recess externally of the protector. The protector also has a cap portion sealed with respect to the lubricant reservoir recess above the point of communication between the flow path and the lubricant passage and connected to the bit body by a connector so as to retain the diaphragm in the lubricant reservoir recess.

35 Claims, 3 Drawing Sheets

FIG. 3
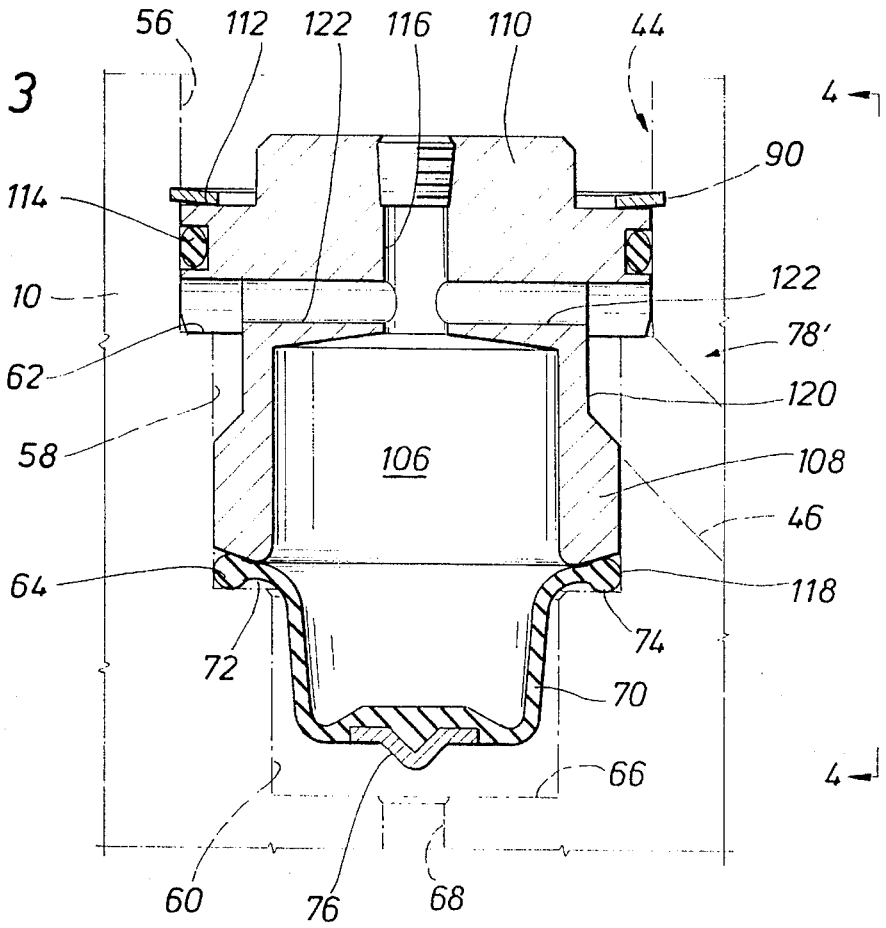
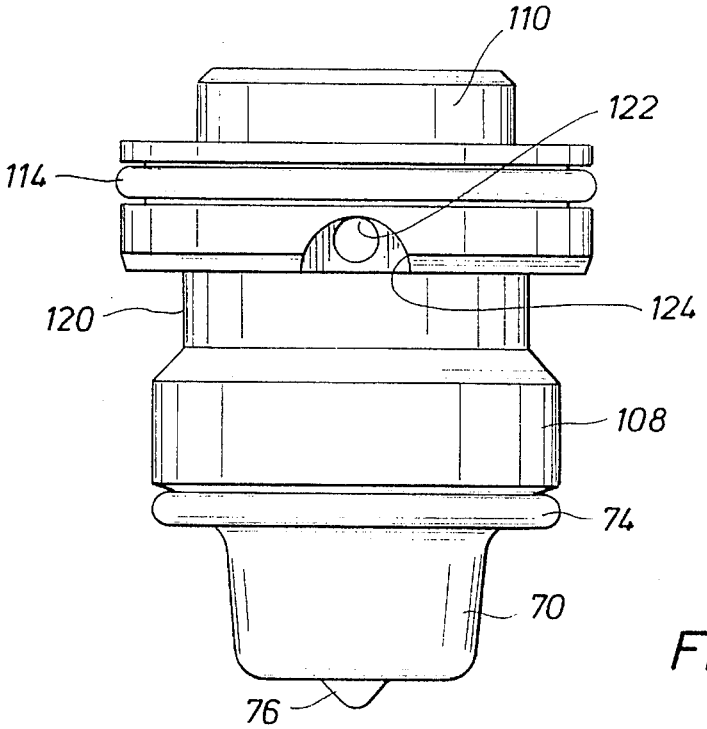
FIG. 4

EARTH BORING BIT AND LUBRICATOR COMPENSATION THEREFOR

BACKGROUND

The present invention pertains to the type of well drilling bit commonly referred to as a "roller cone" bit or "rock" bit. Such a bit typically includes a main bit body which is attached to and rotates with the drill string. The bit body includes a centralized portion, which has the joint for attachment to the drill string at one end, and also includes a plurality of radially and circumferentially spaced legs depending longitudinally from the other end of the centralized portion. A rolling cutter body or "cone" is rotatably mounted on the free end of each of these legs. Thus, as the bit body is rotated by the drill string, these cones are caused to roll along the bottom of the hole being drilled, and teeth on the cones disintegrate the earth formation.

Rotary bearings are provided between the cones and their respective legs, and these bearings must be lubricated. An annular seal is provided at the free or open end of the bearing interface between the cone and the bit leg in order to keep the lubricant in the bearing and exclude well fluids, and the abrasives they carry, from the bearing. It is very important that the integrity of these bearing seals be maintained. If it is not, the bearing can be ruined. This not only makes repair difficult and expensive, if not impossible, but drilling must be temporarily stopped, and the drill string tripped to replace the bit, an extremely expensive operation.

Accordingly, such bits are typically provided with a respective lubricant reservoir recess for each cone, and in this recess is disposed a mechanism which contains a supply of lubricant, which can be urged toward the bearing through an interconnecting lubricant passage, to keep the bearing supplied and replace any lubricant which is lost; the mechanism also includes a flexible, preferably elastomeric, pressure compensator such as an elastomeric diaphragm, one side of which is exposed to the lubricant pressure, and the other side of which is exposed to the pressure external to the bit in the borehole. The compensator can react to increases in external pressure, so as to ensure that the lubricant pressure is equal thereto, and prevent leakage of drilling fluid into the bearing. Conversely, it can react to decreases in well pressure to reduce the pressure it is exerting on the lubricant, to prevent diaphragm damage, lubricant waste, and/or displacement of or damage to the bearing seal.

There are two basic types of such mechanisms known in the art, distinguished by whether the vent port for exposing the diaphragm to the external borehole pressure opens upwardly through the outer part of the bit body, or downwardly, through the shroud of the bit body.

Examples of so called "top vented" pressure compensators are shown in U.S. Pat. Nos. 3,942,596 and 4,942,930 as well as in the commercial literature of Reed, Walker McDonald, and Rock Bit International, filed herewith. An advantage of the top vented lubricator/compensator mechanism is that it is relatively simple in terms of the number and nature of parts, especially seals, required. In the hostile downhole environment, it is generally the case that, the simpler a mechanism can be, and more particularly the fewer its parts, the less vulnerability to damage, deterioration by well fluids and/or abrasives therein, damage from temperature and pressure conditions, etc.

However, top vented compensators generally suffer from some disadvantages. Specifically, because the vent port which exposes the compensator to the well fluid opens upwardly, this port will not drain or empty naturally, and will typically have to be cleaned out every time the bit is removed from the hole. What is worse, the port is near the outer extremity of the bit. Thus, as the bit is being pulled from the hole, material from the borehole wall may be scraped off:, falling onto, or even being driven into, the port and thence into the top of the mechanism and/or the recess in which it is housed. This can prevent prompt reuse of the bit, because, at best, extensive cleaning and repair may be required.

Examples of bottom vented mechanisms are shown in U.S. Pat. No. 4,865,136, U.S. Pat. No. 4,055,225, U.S. Pat. No. 4,727,942, and the commercial literature of Baker Hughes, filed herewith. The respective advantages and disadvantages of these bottom vented mechanisms are generally converse to those of the top vented mechanisms described above. More specifically, because the vent port opens downwardly, drilling fluid and cuttings can drain therefrom naturally, through force of gravity. Also, because these vent ports open through the shroud of the bit body, and are therefore isolated and protected from the wall of the borehole, there is no significant problem with scraping and cramming of formation into the vent ports and adjacent parts as the bit is pulled from the well. However, these mechanisms are generally more complex, not only utilizing at least two seals, but typically utilizing a greater number of parts in general.

Also, the elastomeric compensators of these mechanisms are typically perforated, rather than solid; in other words, they have integral pressure relief valves which can vent lubricant to the exterior of the bit if the pressure of the lubricant becomes too high and, for example, threatens to rupture the diaphragm and/or displace or damage the bearing seal of the associated cutter. This solution to the excess pressure problem can not only deplete the supply of lubricant available for feeding into the bearing, but because of the perforated nature of the compensator, can involve some danger of leakage of well fluid into the compensator, even though the integral valve thereof is designed to be of a one-way type.

SUMMARY OF THE INVENTION

The present invention seeks to simplify the bottom vented type lubricating/pressure-compensating mechanism, while retaining the other benefits thereof, and preferably providing additional benefits, e.g. in terms of simplicity of overall bit manufacture and greater protection for the integrity of the bearing seal and the purity of the lubricant.

A bit according to the present invention comprises a bit body including a centralized portion and a plurality of radially and circumferentially spaced legs depending longitudinally from the centralized portion. The centralized portion typically includes the tool joint and a further part which provides drilling fluid passages and defines the underside, or shroud of the centralized portion of the bit body. The free end of each leg typically is turned at an angle and machined or otherwise formed as a trunnion on which respective one of the cutter bodies or cones is rotatably mounted with bearing means cooperative therebetween.

The bit body has a respective lubricant passage therethrough communicating with each bearing and with a respective upwardly opening lubricant reservoir recess, distal the respective bearing, and which recess also communicates with a respective vent port opening downwardly through the bit body radially inwardly of the respective leg, typically through the shroud of the bit body.

A respective lubricating mechanism is disposed in each lubricant reservoir recess, and each of these mechanisms in turn comprises an elastomeric pressure compensating diaphragm extending across the lubricant reservoir recess, and sealed with respect thereto, thereby dividing the recess into a lower portion communicating with the vent port and an upper portion communicating with the lubricant passage.

Whereas known prior art bottom vented mechanisms have typically included a diaphragm protector or "can" and a separate closure cap for the recess, the present invention utilizes an integral diaphragm protector which includes the cap as a part thereof. The protector is located generally above the diaphragm in the upper portion of the recess. It has a downwardly opening, primary cavity for receipt of lubricant and aligned to also receive the diaphragm, when the diaphragm is contracted as will be explained below. The protector also has a flow path communicating the interior of the primary cavity with the upper portion of the lubricant reservoir recess externally of the protector. The integral cap portion of the protector is sealed with respect to the lubricant reservoir recess above the point of communication with the lubricant passage and connected to the bit body by connector means so as to retain the diaphragm in the lubricant reservoir recess.

In preferred embodiments, the diaphragm has a radially outwardly extending annular flange with a sealing formation, e.g. a thickened portion forming a sort of integral o-ring or partial o-ring, adjacent its outer edge. The lubricant reservoir recess has an internal annular upwardly facing shoulder on which this diaphragm flange rests. The protector has an annular lower end, defining the mouth or open end of the primary cavity, which opposes the shoulder of the recess and abuts the sealing formation of the diaphragm. The protector is sized so that, when it is connected to the bit body by the connector, it bears on the sealing formation, not only retaining the diaphragm, as mentioned, but also compressing the sealing formation to form a tight seal.

In at least some known prior art bottom vented mechanisms, there is not only a retainer ring securing the cap to the bit body, but another hold down element, such as a bellville spring, stacked with the retainer ring so as to provide the necessary force of the abutting protector against the flange or lip of the diaphragm. In accord with one aspect of the present invention, only a single retainer ring is used, directly interengaging the cap portion of the integral protector and the bit body, with the protector being carefully sized so that, when so engaged by the retainer ring, it will provide the necessary compressive force on the diaphragm flange.

In accord with another aspect of the invention, the diaphragm itself is not perforated or valved, but rather solid. The diaphragm and the lubricant reservoir recess are respectively sized to provide a clearance between the bottom of the recess and the diaphragm. The clearance is of adequate size to allow sufficient stretching of the diaphragm to accommodate anticipated thermal expansion of lubricant without the necessity of venting lubricant to the exterior of the bit body. Of course, the diaphragm itself is engineered to be able to accommodate this stretching without failure. In preferred embodiments, the volume of the aforementioned clearance represents about 8% to 10% of the available volume for lubricant in the recess, the lubricant passage and the bearing, with the diaphragm relaxed (neither stretched nor collapsed).

In another aspect of the invention, the external surface of the protector has a relieved zone defining an external annular lubricant groove communicating with the lubricant passage and the flow path. More specifically, at least part of this flow path is defined by at least one and preferably a plurality, of lateral lubricant ports communicating with the external annular lubricant groove. In one embodiment, the lateral lubricant ports may communicate directly with the primary cavity. The diaphragm preferably has a cup-shaped portion radially inwardly of the flange, which is normally disposed below the protector mouth to mouth with the open or lower end of the primary cavity. However, depending upon the pressure conditions and the amount of lubricant left in the system, this cup-shaped portion of the diaphragm may, so to speak, turn inside-out and contract or collapse up into the primary cavity. When this happens, further pressure fluctuations and/or small lubricant leaks will tend to move the diaphragm up and down. In those embodiments in which the lateral lubricant ports communicate directly with the primary cavity, the inner diameter of the primary cavity may be relieved in the vicinity of the lateral lubricant ports so as to minimize the possibility of scraping or cutting of the diaphragm when it is in such contracted or collapsed configuration.

The protector preferably also has a longitudinal fill bore extending through the top of the cap portion and into the top of the primary cavity. In other embodiments, the lateral lubricant ports may communicate with this longitudinal bore, distal the primary cavity, thus providing even better protection to the diaphragm when it collapses or contracts. The outer ends of these lateral lubricant ports may be longitudinally spaced from the external annular lubricant groove. In such instances, the external surface of the protector may have a respective bridge relief between each lateral lubricant port and the external annular lubricant groove.

In addition to a complete bit body, the present invention also encompasses a lubricating/pressure-compensating mechanism per se, having features such as described above, as well as additional features to be described below.

Other details of exemplary embodiments of the present invention, as well as various objects and advantages of the invention, will be made more apparent by the following detailed description, the drawing and the claims.

BRIEF DESCRIPTION OF THE DRAWING

FIG. 3 is a view similar to that of FIG. 2 showing another embodiment of lubricating/compensator mechanism.

FIG. 4 is a side elevational view taken on the line 4—4 of FIG. 3.

DETAILED DESCRIPTION

Figure 1:
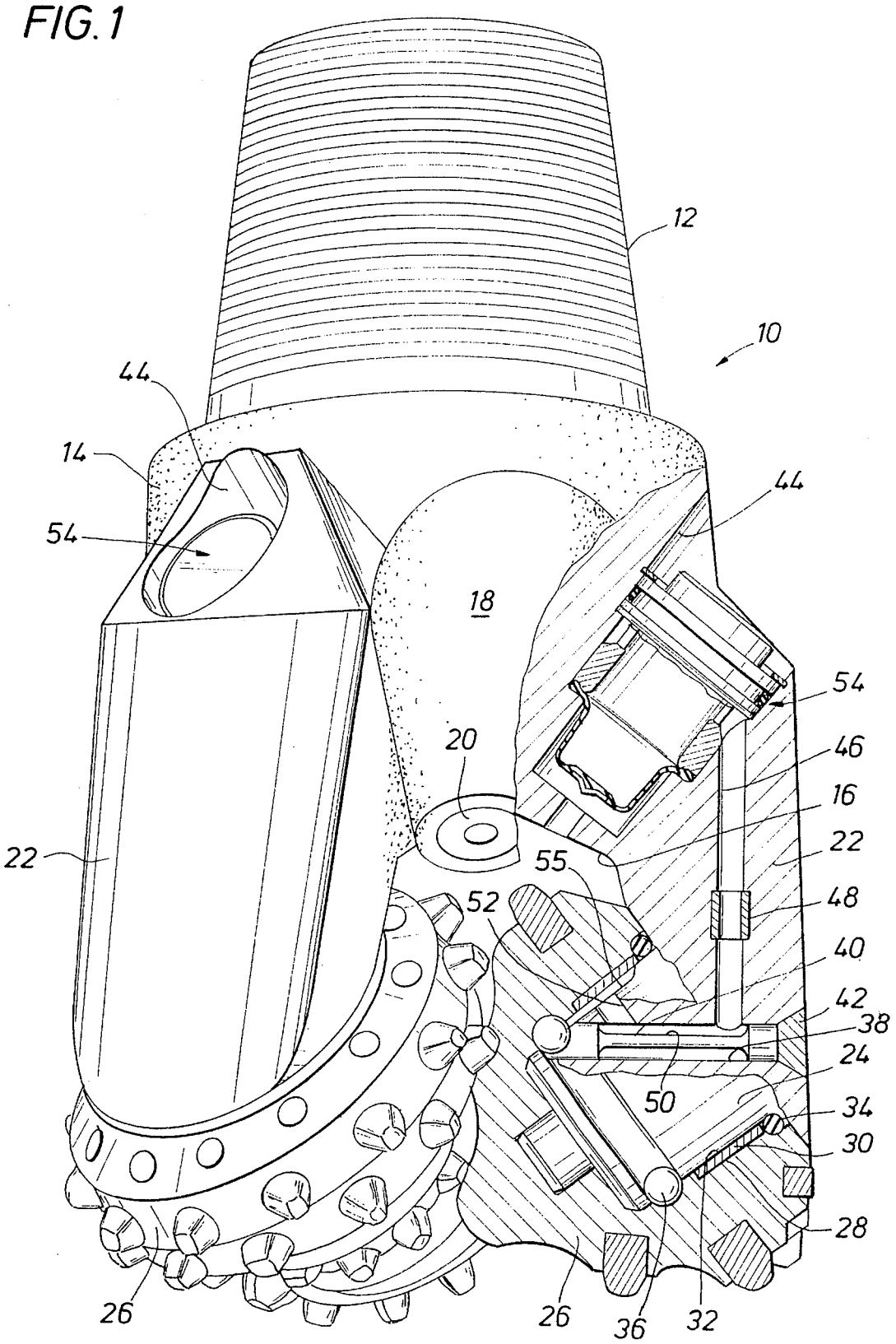
FIG. 1 is a side elevational view of a bit in accord with one embodiment of the present invention with one bit leg and associated parts being shown in longitudinal cross-section.

FIG. 1 shows a well drilling bit according to a first embodiment of the present invention. The bit includes a bit body 10 which is shown in the position it would assume in use in a vertical hole. Terms such as "upper" and "lower" are used herein for convenience with reference to this traditional position, and are not intended to be limiting, e.g. if the bit is used in horizontal drilling or is placed in a different position for purposes of manufacture or repair. Also, unless otherwise indicated, such terms are used in a general sense, e.g. a port may be "upwardly opening" if it is disposed at an angle with a significant vertically upward component.

The bit body includes a centralized portion including an uppermost threaded pin 12 for connecting the bit to the lowermost drill pipe, collar or other member in a drill string. Below pin 12, the centralized portion of the bit body has an enlarged part 14, The underside of this enlarged part 14 is referred to as the shroud 16 of the bit. As well known in the art, a large central bore (not shown) extends downwardly through pin 12 and into part 14, where it branches into a plurality (typically three) of passages (also not shown), each of which extends through an enlarged nozzle mounting portion of the bit body, one of which is shown at 18. In the bottom of each nozzle mounting portion, there is mounted a nozzle 20. Drilling mud is typically pumped downwardly through the passages in the centralized portion of the bit body,, and out through the nozzles 20 to cool the cutters (to be described below) and flush cuttings away from the cutters and back up through the annulus of the well.

In addition to the centralized portion 12, 14, bit body 10 includes a plurality (typically three) of legs depending downwardly from the centralized portion in radially and circumferentially spaced relation to one another. For clarity of illustration, only 2 such legs 22 are shown in FIG. 1. The lowermost portion of each leg 22 is inclined radially inwardly and downwardly, and suitably o machined, to form a trunnion 24.

A respective cutter or cone 26 is mounted on each trunnion 24. The hollow interior of the cone is formed to cooperate with the specific form of the trunnion. More specifically, the trunnion 24 has, near its upper end, a relatively large cylindrical section 28 which is surrounded by a journal bearing 30, cooperative between cylindrical section 28 and a corresponding cylindrical section 32 of the interior of cone 26. Upwardly of the cylindrical sections 28 and 32, the trunnion and cone are adapted to receive an annular bearing seal 34, which may be an elastomeric o-ring, as shown. Below cylindrical sections 28 and 32, the trunnion and cone have opposed arcuate grooves which, together, form a ball race for receiving a set of balls 36. The balls are inserted through a bore 38, after which a relieved pin 40 is inserted into the bore 38 and retained by a plug weld 42. Thus, the balls retain the cone 26 on the trunnion 24, and also may provide further rotary and inward thrust bearing functions.

The centralized portion of the bit body 10 has three upwardly opening lubricant reservoir recesses 44, each of which is located just above one of the legs 22. A lubricant passage in the form of a bore 46 extends downwardly through a respective one of the legs 22, interconnecting the respective reservoir 44 with the respective bore 40. (The small sleeve 48 is formed from a dowel used in certain manufacturing techniques wherein the leg is formed of two parts welded together along a generally transverse interface. The dowel is later drilled out to form sleeve 48.) By means to be described more fully below, lubricant in the reservoir 44 is urged into and through passage 46 whence it can enter the relieved area 50 of pin 40, and pass along that pin into the ball race, as well as through a lateral port 52 which interconnects the bore 38 with the journal bearing area. To assist in the distribution of lubricant about the journal bearing formed by opposed surfaces of the cylindrical section 28 of the trunnion and the bearing sleeve 30, the former may have a lengthwise relief groove 55 of limited circumferential extent.

Figure 2:
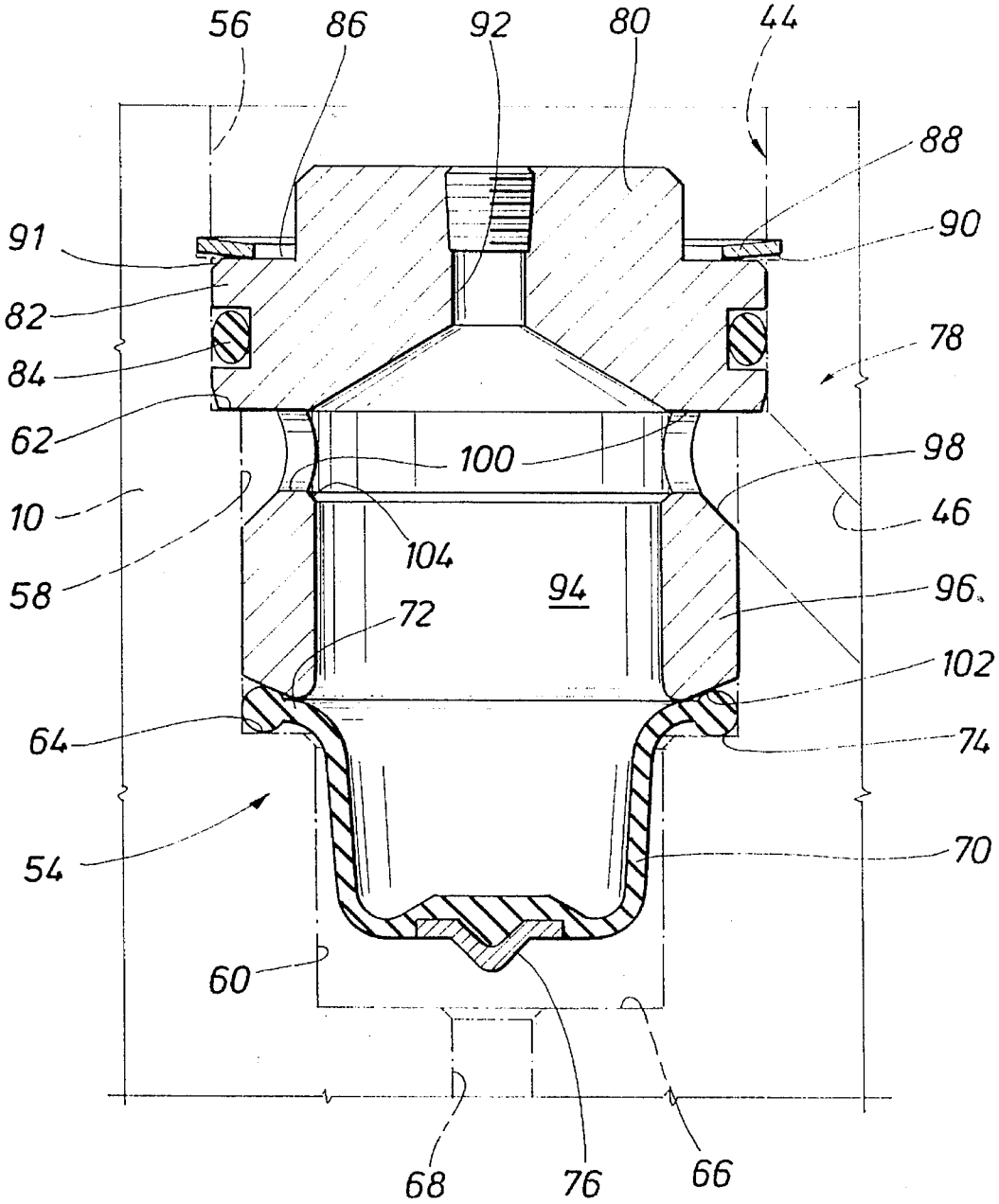
FIG. 2 is an enlarged longitudinal cross-sectional view of the lubricating/compensator mechanism shown in the bit of FIG. 1.

Referring now jointly to FIGS. 1 and 2, an exemplary one of the combination lubricating/compensator mechanisms 54, each of which is disposed in a respective reservoir 44 will be described. The reservoir 44 itself has three cylindrical sections 56, 58, and 60, of decreasing diameters, and forming upwardly facing annular shoulders 62 and 64 between each two adjacent sections. At the lower end of section 60 is the bottom 66 of the recess, and in the center of bottom 66 is a longitudinal vent port 68 which opens out through the shroud 16 of the bit body.

The lubricating/compensator mechanism includes the compensator proper 70, formed of a solid, i.e. unperforated, elastomer such as oil resistant rubber or nitrile rubber compound. In its normal or relaxed condition, the compensator 70 has a primary, central cup-shaped portion which is disposed generally within cylindrical section 60 of the recess 44 and opens upwardly toward section 58. Integral with the cup-like portion of compensator 70 is an annular flange portion 72 extending radially outwardly from the mouth of the cup-like portion, and terminating in a thickened bead or sealing formation 70, which acts like an o-ring seal. Flange 72 is sized to rest on shoulder 64 in the reservoir. The bottom or closed end of the cup-like portion of compensator 70 is thickened, and forms a downwardly directed point at its center, the point being reinforced by a metal piece 76 bonded to the elastomer.

The other major part of the lubricating/compensator mechanism is an integral rigid, typically metallic, combination diaphragm protector and cap 78. The uppermost or cap portion thereof has an upper relatively small diameter part 80 and a larger diameter part 82 sized generally to fit within section 56 of the reservoir. Portion 82 has an external annular groove housing an o-ring seal 84 which seals against section 56 of the reservoir. An upwardly facing annular shoulder 86 is formed between parts 80 and 82. This shoulder 136 is engaged by a retainer ring 88 the outer edge of which fits in a mating groove 90 in section 56 of the reservoir. The retainer ring 88 may be a simple snap ring, or in other embodiments, may also be inclined so that it likewise serves as a small bellville spring. A fill bore 92 extends vertically through the cap portion, of the integral combination 78 with its lower end opening into the primary cavity of the protector portion (to be described below) and its upper end threaded for purposes likewise described below.

The lower or diaphragm protector portion 96 of the combination 78 has a primary, downwardly opening cavity 94. The protector portion 96 has its diameter generally sized to fit the section 58 of the reservoir. However, at its upper end, i.e. adjacent its juncture with the cap portion 80, 82, its outer diameter is relieved to form an external annular groove 98. At least two lateral lubricant ports 100 communicate the interior of the primary cavity 94 with the groove 98. As shown, when the combination 78 is properly secured in the bit body, the groove 98 is aligned with lubricant passage 46. Also, the thickness of the lower, unrelieved portion of protector 96 generally corresponds to the radial dimension of the flange 72 of the compensator 70 as well as to that of shoulder 64. The length of the combination 78 and the placement of the groove 90 for the retainer ring 80 are such that, when connected to the drill bit, the protector 96 will be urged downwardly into tight engagement with the flange 72, and more specifically, its sealing bead 74. Although it has been known to incline both the lower surface of a protector and the opposed shoulder in the bit body, the present inventor considers it preferable to simplify the machine work required on the bit body, in favor of the relatively small member 78. Accordingly, to help ensure that the flange 72 remains in place, and more specifically, that its sealing bead 74 remains in tight sealing engagement between the shoulder 64 and the surface 102, the later is inclined radially outwardly and upwardly from a point radially inward of the sealing bead 74, preferably at an angle of at least about 10°, more preferably at least about 15°, and most preferably about 20°.

In use, after the assembly 54 has been installed, as indicated in FIGS. 1 and 2, a fitting is connected to the threaded upper end of bore 92, and a vacuum is drawn on the area potentially available for containment of lubricant, i.e. the interior of diaphragm 70, cavity 94, ports 100, groove 98, passage 46, the clearance between pin 40 and its bore 38, and the space within the bearings themselves. Then, a suitable lubricant is introduced, likewise through bore 92, at a sufficient volume and pressure to fill diaphragm 70 and protector 96 in the normal, but unstretched, condition of the diaphragm, while the system is still under a vacuum. Then, the bore 92 is plugged by a plug receivable in the same threaded outer end portion.

The groove 90 is beveled as indicated at 91 in order to prevent damage to the o-ring 84.

It is particularly to be noted that in this initial condition, prior to running into the well, there is a substantial clearance between the bottom of diaphragm 70 and the bottom 66 of the recess 44. The size of this clearance is calculated to allow sufficient stretching of the diaphragm to accommodate anticipated thermal expansion of lubricant downhole, without the necessity of perforating the diaphragm so as to vent lubricant to the exterior of the bit body. The metal piece 76 helps to protect the elastomeric diaphragm 70 from damage by engagement with the vent port 68, and the inner edge of this port is also beveled. The aforementioned clearance between the bottom of the diaphragm 70 and the bottom 66 of the recess will preferably be approximately 8% to 10% of the total volume available for lubricant, with the diaphragm 70 unstretched.

This ensures that there is a positive pressure urging lubricant into the bearing area as the bit proceeds through the hole. Since one side of the diaphragm 70 is exposed, through port 68, to the pressure within the borehole, and the other side is exposed to the pressure of the lubricant in the bearing, and because of the aforementioned clearance, the diaphragm can move up or down tending to equalize these pressures. This will ensure that drilling fluids and/or abrasives carried thereby do not leak past the bearing seal 34, which could not only destroy the seal, but also the bearing itself. Conversely, excessive pressure on the lubricant and the bearing seal 34 is also avoided. Expansion of diaphragm 70 is limited by the bottom 66 of the recess 44, so that the, diaphragm will not break or rupture.

Under some circumstances, the diaphragm 70 will collapse or contract into the primary cavity 94 of the protector 96. The inner diameter of cavity 94 is enlarged in the vicinity of the ports 100, and the transition between the lower section and the enlarged section beveled, both as indicated at 104, to reduce the chance of damage to the diaphragm 70 under such conditions. It should be borne in mind that, under these conditions, the collapsed or contracted diaphragm 70 can still move longitudinally, and under such conditions, could be moving back and forth across the edges of the ports 100. This is particularly likely if there is, for one reason or another, a small lubricant leak, for when that occurs, it is common for the diaphragm to move slightly up and down and pump grease toward the bearing. Thus, the potential damage minimized by the enlargement/beveling 104 is considerable.

FIGS. 3 and 4 show an alternate embodiment which offers certain advantages over the embodiment of FIGS. 1 and 2, including even better protection for the diaphragm in a collapsed condition. This embodiment includes a compensator proper which is identical to that of the first embodiment, and therefore labeled with identical reference numerals 70 through 76. The integral protector/cap combination 78' includes certain differences, particularly in the flow path by which lubricant from within the diaphragm 70 and the opposed primary cavity 106 of the protector 108 is communicated to the lubricant passage 46 of the bit body 10.

The cap portion 110 of member 78' is similar to that of the first embodiment in that it includes an upwardly facing shoulder for engagement by a retainer ring 112 also extending into the groove 90 in the recess 44; in that it has an external annular groove carrying an o-ring seal 114 disposed above the point of communication of the flow path (to be described below) and the lubricant passage 46 in the bit body 10; and in that there is a longitudinal fill bore 116 extending through the cap portion 110 into the top of the primary cavity 106, and having its outer end threaded for the same purposes as described above in connection with the first embodiment.

The protector portion 108 of the integral combination 78' is also similar to that of the first embodiment in that it has an inclined lower end 118 for cooperation with the sealing bead 74, and, in alignment with passage 46, an external annular groove 120.

However, the side walls of primary cavity 106 are smooth and closed; specifically, there are no lateral ports therethrough. Instead, there are two lateral lubricant ports 122 extending laterally into the lower part of the cap portion 110, below the groove for the o-ring 114, at right angles to and intersecting the bore 116. Because these bores 122 are spaced slightly above the lower edge of cap portion 110, and therefore spaced from the groove 120, the cap portion has a pair of arcuate bridge reliefs 124 machined thereinto to communicate the bores 122 with the groove 120 (see especially FIG. 4).

It can be seen that, if the diaphragm 70 should collapse into primary cavity 106, and should then move up and down with a pumping action due, for example, to a slight lubricant leak in the system, it will not be moving back and forth across any edges whatsoever.

Numerous modifications of the preferred embodiments described above will suggest themselves to those of skill in the art. Accordingly, it is intended that the scope of the invention be limited only by the following claims.

What is claimed is:

1. A well drilling bit comprising:

a bit body including a centralized portion and a plurality of radially and circumferentially spaced legs depending longitudinally from the centralized portion;

a respective cutter body rotatably mounted on the free end of each leg with beating means cooperative between each leg and the respective cutter body;

wherein the bit body has a respective lubricant passage therethrough communicating with each bearing and with an upwardly opening lubricant reservoir recess distal the respective bearing, the lubricant reservoir recess also communicating with a respective vent port opening downwardly through the bit body radially inwardly of the respective leg;

a respective lubricating mechanism in each lubricant reservoir recess, each lubricating mechanism comprising an elastomeric pressure compensating diaphragm extending across the lubricant reservoir recess and sealed with respect thereto, dividing the recess into a lower portion communicating with the vent port and an upper portion communicating with the lubricant passage, said diaphragm having a major, laterally outer, flexible portion;

an integral diaphragm protector located above the diaphragm in the upper portion of the lubricant reservoir recess, having a primary, downwardly opening cavity for receipt of lubricant and receiving at least a portion of the diaphragm, including said major portion when the diaphragm is contracted, and having a flow path communicating the interior of the primary cavity with the upper portion of the lubricant reservoir recess externally of the protector, the protector further comprising a cap portion sealed with respect to the lubricant reservoir recess above the point of communication between the lubricant passage and the flow path and connected to the bit body by connector means so as to retain the diaphragm in the lubricant reservoir recess, the external surface of the protector having a relieved zone defining an exterior, annular lubricant groove communicating with the lubricant passage and the flow path, and at least one lateral lubricant port interconnecting the external annular lubricant groove directly with the primary cavity to form at least part of the flow path, the inner diameter of the protector in the primary cavity being relieved in the vicinity of the lateral lubrication port.

2. The apparatus of claim 1 wherein the diaphragm has an annular flange extending radially outwardly from said major portion, with a sealing formation adjacent the outer edge of the flange; the lubricant reservoir recess has an internal, annular, upwardly facing shoulder; and the protector has a lower end opposing the shoulder and abutting the sealing formation;

and the protector is sized to bear on and compress the sealing formation when the protector is so connected to the bit body.

3. The apparatus of claim 2 wherein the connector means is a retainer ring directly interengaging the cap portion of the protector and the bit body.

4. The apparatus of claim 2 wherein the diaphragm is solid; and the diaphragm and lubricant reservoir recess are respectively sized to provide a clearance between the bottom of the recess and the diaphragm of adequate size to allow sufficient stretching of the diaphragm to accommodate anticipated thermal expansion of the lubricant without the necessity of venting lubricant to the exterior of the bit body.

5. The apparatus of claim 4 wherein the volume of the clearance is approximately 8% to 10% of the volume for lubricant in the lubricant reservoir recess, lubricant passage and bearing, with the diaphragm relaxed.

6. The apparatus of claim 2 wherein the shoulder is perpendicular to the adjacent side walls of the upper and lower portions of the recess.

7. The apparatus of claim 6 wherein the lower end of the protector is inclined radially outwardly and upwardly from a point radially inwardly of the sealing formation.

8. The apparatus of claim 7 wherein the angle of inclination of the lower end of the protector is at least about 10° to a straight radial direction.

9. The apparatus of claim 8 wherein said angle is at least about 15°.

10. The apparatus of claim 9 wherein said angle is about 20°.

11. The apparatus of claim 2 comprising a plurality of such lateral lubricant ports.

12. The apparatus of claim 2 wherein the protector has a longitudinal fill bore communicating with the primary cavity through the top of the primary cavity and opening upwardly through the cap portion of the protector, the longitudinal fill bore having an upper end adapted to alternately receive (a) a fitting for introducing or withdrawing fluid and (b) a plug.

13. The apparatus of claim 2 wherein the cap portion of the protector has an external annular groove located above the point of communication between the flow path and the lubricant passage and carrying an annular seal for sealing with respect to the bit body.

14. The apparatus of claim 13 wherein the lubricant reservoir recess has generally cylindrical side walls.

15. The apparatus of claim 1 wherein the diaphragm, in a relaxed condition, has a cup-like portion disposed below the shoulder and opening upwardly and wherein said major portion comprises the sides of the cup-like portion.

16. A well drilling bit comprising:

a bit body including a centralized portion and a plurality of radially and circumferentially spaced legs depending longitudinally from the centralized portion;

a respective cutter body rotatably mounted on the free end of each leg with bearing means cooperative between each leg and the respective cutter body;

wherein the bit body has a respective lubricant passage therethrough communicating with each bearing and with an upwardly opening lubricant reservoir recess distal the respective bearing, the recess also communicating with a respective vent port opening downwardly through the bit body radially inwardly of the leg, the lubricant reservoir recess having a centerline and an internal, annular, upwardly facing shoulder perpendicular to the centerline;

a respective lubricating mechanism in each lubricant reservoir recess, each lubricating mechanism comprising an elastomeric pressure compensating diaphragm extending across the lubricant reservoir recess and sealed with respect thereto, dividing the recess into a lower portion communicating with the vent port and an upper portion communicating with the lubricant passage, the diaphragm having a radially outwardly extending annular flange, with a sealing formation adjacent its outer edge disposed on the shoulder of the lubricant reservoir recess;

an integral diaphragm protector located generally above the diaphragm in the upper portion of the lubricant reservoir recess, having a primary, downwardly opening cavity for receipt of lubricant and aligned to receive the diaphragm when the diaphragm is contracted, the protector having a lower end opposing the shoulder of the lubricant reservoir recess and abutting the sealing formation of the diaphragm, said lower end being inclined radially outwardly and upwardly from a point radially inwardly of the sealing formation, the protector further having a flow path communicating the interior of the primary cavity with the upper portion of the lubricant reservoir recess externally of the protector, and the protector further comprising a cap portion sealed with respect to the lubricant reservoir recess above the point of communication between the flow path and the lubricant passage and connected to the bit body by an inflexible retainer ring directly interengaging the cap portion of the protector and the bit body.

17. The apparatus of claim 16 wherein the external surface of the protector has a relieved zone defining an exterior, annular lubricant groove communicating with the lubricant passage and the flow path.

18. The apparatus of claim 17 wherein the protector has at least one lateral lubricant port communicating with the external annular lubricant groove and forming at least part of the flow path.

19. The apparatus of claim 18 comprising a plurality of such lateral lubricant ports.

20. The apparatus of claim 19 wherein the lateral lubricant ports communicate directly with the primary cavity.

21. The apparatus of claim 20 wherein the inner diameter of the protector in the primary cavity is relieved in the vicinity of the lateral lubrication ports.

22. The apparatus of claim 18 wherein the protector has a longitudinal fill bore communicating with the primary cavity through the top of the primary cavity, and the lateral lubricant ports communicate with the longitudinal bore.

23. The apparatus of claim 22 wherein the lateral lubricant ports are generally perpendicular to the longitudinal fill bore.

24. The apparatus of claim 23 wherein the lateral lubricant ports are longitudinally spaced from the external annular lubricant groove, and the external surface of the protector has a respective bridge relief between each lateral lubricant port and the external annular lubricant groove.

25. The apparatus of claim 22 wherein the lateral lubricant ports are longitudinally spaced from the external annular lubricant groove, and the external surface of the protector has a respective bridge relief between each lateral lubricant port and the external annular lubricant groove.

26. The apparatus of claim 22 wherein the longitudinal fill bore opens upwardly through the cap portion of the protector and has an upper end adapted to alternately receive (a) a fitting for introducing or withdrawing fluid and (b) a plug.

27. The apparatus of claim 16 wherein the diaphragm is solid; and the diaphragm and lubricant reservoir recess are respectively sized to provide a clearance between the bottom of the recess and the diaphragm of adequate size to allow sufficient stretching of the diaphragm to accommodate anticipated thermal expansion of the lubricant without the necessity of venting lubricant to the exterior of the bit body.

28. The apparatus of claim 27 wherein the volume of the clearance is approximately 8% to 10% of the volume for lubricant in the lubricant reservoir recess, lubricant passage and beating, with the diaphragm relaxed.

29. The apparatus of claim 16 wherein the angle of inclination of the lower end of the protector is at least about 10° to a straight radial direction.

30. The apparatus of claim 29 wherein said angle is at least about 15°.

31. The apparatus of claim 30 wherein said angle is about 20°.

32. The apparatus of claim 16 wherein the protector has a longitudinal fill bore communicating with the, primary cavity through the top of the primary cavity and opening upwardly through the cap portion of the protector, the longitudinal fill bore having an upper end adapted to alternately receive (a) a fitting for introducing or withdrawing fluid and (b) a plug.

33. The apparatus of claim 16 wherein the cap portion of the protector has an external annular groove located above the point of communication between the flow path and the lubricant passage and carrying an annular seal for sealing with respect to the bit body.

34. The apparatus of claim 33 wherein the lubricant reservoir recess has generally cylindrical side walls.

35. The apparatus of claim 16 wherein the diaphragm, in a relaxed condition, has a cup like portion disposed below the shoulder and opening upwardly.

* * * * *